US007090342B2

(12) United States Patent
Aldrich

(10) Patent No.: US 7,090,342 B2
(45) Date of Patent: Aug. 15, 2006

(54) PASSIVE INK PUMP SYSTEM FOR AN INKJET PRINTER

(75) Inventor: Charles Stanley Aldrich, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 586 days.

(21) Appl. No.: 10/802,965

(22) Filed: Mar. 17, 2004

(65) Prior Publication Data

US 2005/0206698 A1 Sep. 22, 2005

(51) Int. Cl.
*B41J 2/175* (2006.01)

(52) U.S. Cl. ..... 347/85

(58) Field of Classification Search ..... 345/84, 345/85; 400/283, 328, 382
See application file for complete search history.

(56) References Cited

U.S. PATENT DOCUMENTS 4,429,320 A * 1/1984 Hattori et al. ..... 347/86
5,686,947 A 11/1997 Murray et al.
5,777,646 A * 7/1998 Barinaga et al. ..... 347/86
5,871,291 A * 2/1999 Kawazoe ..... 400/279
6,084,618 A 7/2000 Baker
6,145,971 A 11/2000 Baker et al.
6,199,977 B1 3/2001 Komplin et al.
6,224,198 B1 * 5/2001 Cook et al. ..... 347/85
6,431,694 B1 8/2002 Ross

* cited by examiner

*Primary Examiner*—Anh T. N. Vo
(74) *Attorney, Agent, or Firm*—Taft, Stettinius & Hollister LLP

(57) ABSTRACT

A print carriage and ink supply system for a printer includes: (a) a print carriage adapted for lateral reciprocation along a print medium within a printer, where the print carriage includes at least one print head; (b) an ink pump including an ink inlet in fluid communication with an ink source, an ink outlet in fluid communication with the print head, and a pump actuator for at least initiating displacement of ink through the ink pump upon actuation; and (c) an inertial mass coupled to the print carriage for reciprocating movement with respect to the print carriage in opposing reaction to acceleration of the print carriage laterally along the print medium; where the inertial mass is indirectly linked to the pump actuator by a mechanical linkage such that the combination of the inertial mass and mechanical linkage actuates the pump at least upon certain accelerations of the print carriage laterally along the print medium.

54 Claims, 3 Drawing Sheets

PASSIVE INK PUMP SYSTEM FOR AN INKJET PRINTER

BACKGROUND OF THE INVENTION

The present invention relates to ink jet printers and, more particularly, to pumping systems used to deliver ink from the ink source to the print head.

Inkjet printers are one of the most widely used print technologies, providing low cost, high speed, and high resolution printing. In order to print at high resolutions while maintaining high speed of operation, it is desired that a steady flow of ink is rapidly delivered to the print head. Various means have been employed in the art to deliver ink to the print head. Some ink jet systems, particularly the low-end models, have used disposable ink supply cartridges mounted on the print carriage, directly coupled to the print head. Other ink jet systems have used an electrically-powered pump to deliver the ink from a fixed supply tank to the print heads located on the print carriage.

U.S. Pat. Nos. 6,145,971 and 6,431,694 describe ink jet systems employing an ink pump driven by the motion of the print carriage; and, more specifically, driven by a passive inertial mass that moves in reaction to the acceleration of the print carriage. Such passively-driven ink pumps represent an important step in ink jet technology because they provide a mechanically simple pump that can be mounted directly on the print carriage. One of the shortcomings of this passively-driven ink pump seen in the prior art is the mass and, hence, the volume required to produce a pump that can achieve the pressures and flow rates required for commercial ink jet printers is too large. In order to supply enough force to generate the required pump capacity, the inertial mass as implemented in the prior art must be sufficiently large that it presents significant design limitations to the installation of the pump on the print carriage. If multiple ink pumps are required, as is necessary in a color printer, it becomes substantially difficult and impractical to fit the ink pumps on the print carriage due to their size.

In light of these shortcomings, there is a desire for a passive ink jet pump driven by an inertial mass that is smaller and lighter than those previously developed.

SUMMARY

Exemplary embodiments of the present invention employ the inertial motion of a mass coupled to an ink jet printer's print carriage to drive a displacement-type ink pump located on the carrier. The pump delivers the ink, which is stored off the carrier, to the print heads. In accordance with the present invention, a mechanical linkage, such as a lever mechanism, is employed to couple the inertial mass to the pump's actuator, which in the exemplary embodiments includes a diaphragm and/or "displacement volume." The mechanical advantage provided by this mechanical linkage allows a sufficiently smaller inertial mass to achieve the required pump capacity, thus enabling multiple ink supply pumps to be fitted to the print head carrier if desired.

It is a first aspect of the invention to provide a print carriage and ink supply system for a printer that includes: a print carriage adapted for lateral reciprocation along a print medium within a printer; an ink pump including an ink inlet in fluid communication with an ink source, an ink outlet in fluid communication with the print head on the print carriage, and a pump actuator for at least initiating displacement of ink through the ink pump upon actuation; and a pendulum pivotally coupled to the print carriage for pivotal movement with respect to the print carriage in reaction to acceleration of the print carriage laterally along the print medium, where the pendulum is mechanically linked to the pump actuator. In such a system the pendulum actuates the pump at least upon certain accelerations of the print carriage laterally along the print medium. In more detailed embodiment the pendulum is pivotally coupled to the print carriage at a pivot point and includes an internal mass arm extending below the pivot point and an actuator arm extending above the pivot point, where the actuator arm is mechanically linked to the pump actuator. In a further detailed embodiment the actuator arm is coupled to a piston carried on the ink pump and the piston is in contact with the pump actuator along at least a portion of the piston's reciprocation path. In yet a further detailed embodiment, the pump is a displacement type pump. In yet a further detailed embodiment, the pump is a diaphragm pump and the pump actuator includes a pump diaphragm enclosing at least a portion of a displacement volume of the diaphragm pump. In yet a further detailed embodiment, the diaphragm pump includes a pump housing containing: the displacement volume, the pump diaphragm, the pump inlet in fluid communication with the displacement volume, and the pump outlet in fluid communication with the displacement volume. In yet a further detailed embodiment, the pump housing is coupled to the print carriage, the pump housing contains the piston, and the pendulum is pivotally coupled to the pump housing. In yet a further detailed embodiment, the pump housing contains a first check valve in fluid communication with the valve inlet and a second check valve in fluid communication with the valve outlet. In yet a further detailed embodiment, the first and second check valves comprise reed valves.

In an alternate detailed embodiment of the first aspect of the present invention, the pendulum is pivotally coupled to the print carriage at a pivot point and includes an internal mass arm extending below the pivot point and an actuator arm extending above the pivot point, where the actuator arm is mechanically linked to the pump actuator, and the inertial mass arm of the pendulum is substantially longer and heavier than the actuator arm of the pendulum. In a further detailed embodiment, the inertial mass arm has a mass of approximately 2 grams to approximately 200 grams. In yet a further detailed embodiment, the ratio of pivot distance of travel between the inertial mass arm and the actuator arm is between approximately 0.5 and approximately 10 to one.

It is a second aspect of the present invention to provide a print carriage and ink supply system for a printer that includes: a print carriage adapted for lateral reciprocation along a print medium within a printer, where the print carriage includes at least one print head; an ink pump including an ink inlet in fluid communication with an ink source, an ink outlet in fluid communication with the print head, and a pump actuator for at least initiating displacement of ink through the ink pump upon actuation; and an inertial mass coupled to the print carriage for reciprocating movement with respect to the print carriage in opposing reaction to acceleration of the print carriage laterally along the print medium; where the inertial mass is indirectly linked to the pump actuator by a mechanical linkage such that the combination of the inertial mass and mechanical linkage actuates the pump at least upon certain accelerations of the print carriage laterally along the print medium. In a more detailed embodiment, the inertial mass is provided on a first arm of a pendulum pivotally coupled to the print carriage, and the pendulum is a component of the mechanical linkage. In a further detailed embodiment, the mechanical linkage includes a piston pivotally coupled to an opposing arm of the pendulum, the piston is mounted for reciprocation along a piston path on the print carriage, and the piston path includes the pump actuator. In yet a further detailed embodiment, the pump is a displacement type pump. In yet a further detailed embodiment, the pump is a diaphragm pump and the pump actuator includes a pump diaphragm enclosing at least a portion of a displacement volume of the diaphragm pump. In yet a further detailed embodiment, the diaphragm pump includes a pump housing containing: the displacement volume, the pump diaphragm, the pump inlet in fluid communication with the displacement volume, and the pump outlet in fluid communication with the displacement volume. In yet a further detailed embodiment, the pump housing is coupled to the print carriage, the pump housing contains the piston, and the pendulum is pivotally coupled to the pump housing. In yet a further detailed embodiment, the pump housing contains a first check valve in fluid communication with the valve inlet and a second check valve in fluid communication with the valve outlet. In yet a further detailed embodiment, the first and second check valves comprise reed valves.

In an alternate detailed embodiment of the second aspect of the present invention, the pendulum is pivotally coupled to the print carriage at a pivot point and includes an internal mass arm extending below the pivot point and an actuator arm extending above the pivot point, where the actuator arm is mechanically linked to the pump actuator, and the inertial mass arm of the pendulum is substantially longer and heavier than the actuator arm of the pendulum. In a further detailed embodiment, the inertial mass arm has a mass of approximately 2 grams to approximately 200 grams. In yet a further detailed embodiment, the ratio of pivot distance of travel between the inertial mass arm and the actuator arm is between approximately 0.5 and approximately 10 to one.

In another alternate detailed embodiment of the second aspect of the present invention, the inertial mass extends downwardly with respect to the print carriage and reciprocates a swinging motion. In a further detailed embodiment, the inertial mass extends below the print carriage.

In another alternate detailed embodiment of the second aspect of the present invention, the system further includes a plurality of the ink pumps for a corresponding plurality of printer inks. In a more detailed embodiment, the system further includes a corresponding plurality of the inertial mass and mechanical linkage combinations for the respective plurality of the ink pumps. Alternatively, the inertial mass is indirectly linked to each of the pump actuators by the mechanical linkage.

It is a third aspect of the present invention to provide a printer that includes: a printer housing; a drive assembly provided in the printer housing for driving a print medium through the printer housing; a print carriage adapted for lateral reciprocation along a print medium carried by the drive assembly within the printer housing, where the print carriage includes at least one print head; a controller for coordinating the operations of the drive assembly and print carriage with respect to each other; an ink pump provided in the printer housing, including an ink inlet in fluid communication with an ink source, an ink outlet in fluid communication with the print head, and a pump actuator for at least initiating displacement of ink through the ink pump upon actuation; and an inertial mass coupled to the print carriage for reciprocating movement with respect to the print carriage in opposing reaction to acceleration of the print carriage laterally along the print medium; where the inertial mass is indirectly linked to the pump actuator by a mechanical linkage such that the combination of the inertial mass and mechanical linkage actuates the pump at least upon certain accelerations of the print carriage laterally along the print medium.

DETAILED DESCRIPTION

Exemplary embodiments of the present invention employ the inertial motion of a mass coupled to an ink jet printer's print carriage to drive a displacement-type ink pump located on the carrier. The pump delivers the ink, which is stored off the carrier, to the print heads. In accordance with the present invention, a mechanical linkage, such as a lever mechanism, is employed to couple the inertial mass to the pump's actuator, which in the exemplary embodiments includes a diaphragm and/or "displacement volume." The mechanical advantage provided by this mechanical linkage allows a sufficiently smaller inertial mass achieve the required pump capacity, thus enabling multiple ink supply pumps to be fitted to the print head carrier if desired.

Figure 1:
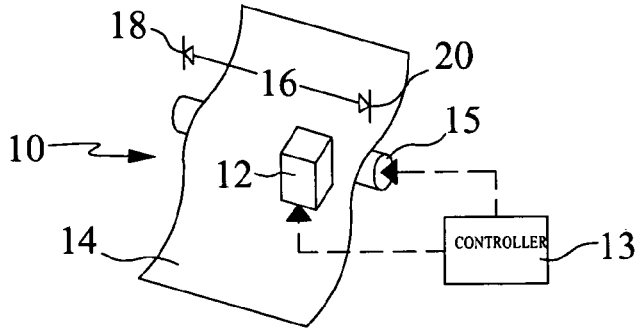
FIG. 1 is a schematic diagram of illustrating conventional ink jet printer components.

As shown in FIG. 1, a conventional inkjet printer 10 contains a print carriage 12 that carries the print heads and related apparatus for applying ink to the print medium or page 14, which is driven through the printer past the print carriage 12 by associated drive mechanisms 15. The coordinated operations of the print carriage 12 and drive mechanism 15 are controlled by one or more controllers 13 as will be appreciated by those of ordinary skill in the art. During print operations, the print carriage 12 typically continuously travels in a lateral direction 16, first accelerating to the left, then momentarily coming to rest upon reaching the left-most position 18, then accelerating to the right, then momentarily coming to rest upon reaching the right-most position 20. This motion is repeated during the print operations. Thus, the print carriage 12 is constantly experiencing acceleration as it accelerates across the page along directional axis 16 and reverses direction at the axis endpoints 18 and 20.

Figure 2:
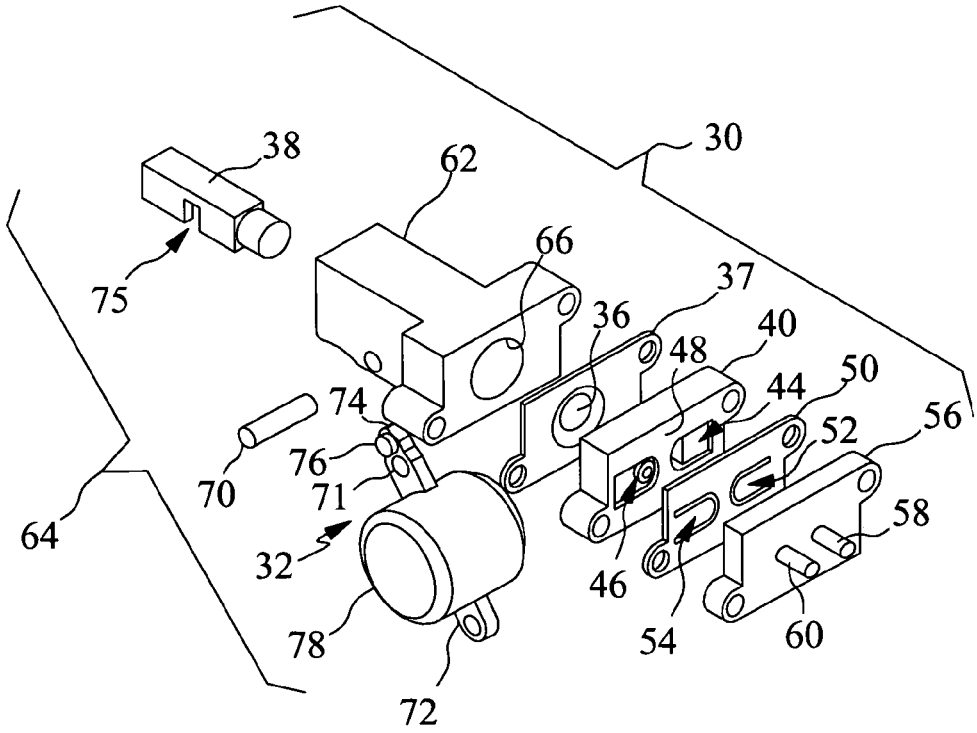
FIG. 2 is a perspective exploded view of an exemplary embodiment of the ink pump according to the present invention.
Figure 3:
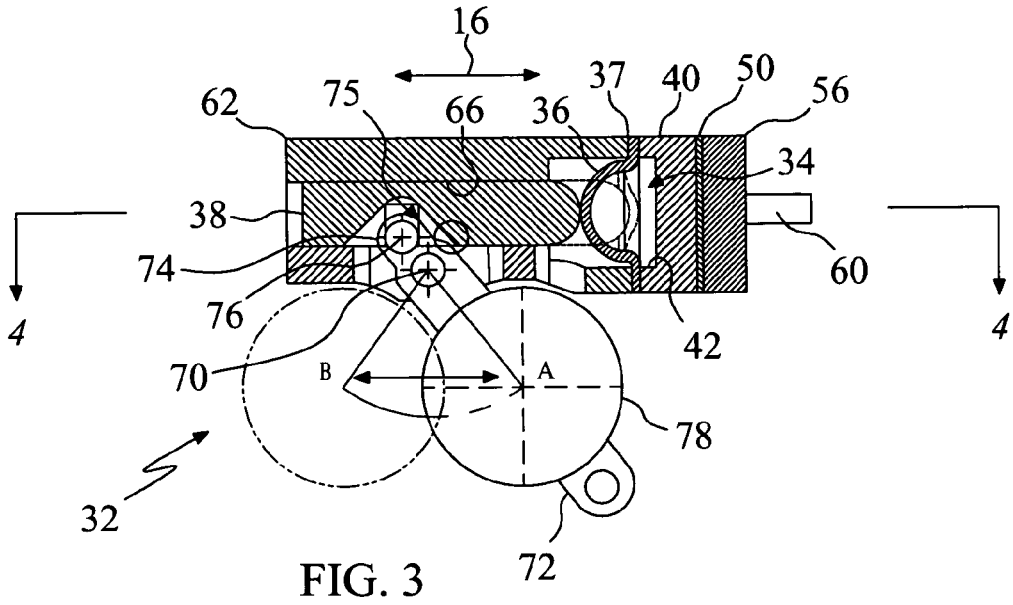
FIG. 3 is an elevational, cross-sectional view of the ink pump of FIG. 2.
Figure 4:
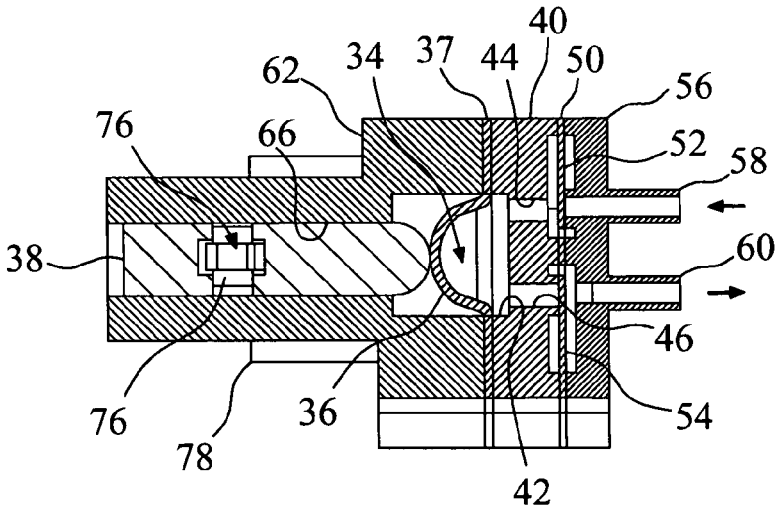
FIG. 4 is a cross-sectional view of ink pump of FIGS. 2 and 3, taken along lines 4—4 of FIG. 3.

As shown by FIGS. 2–4, exemplary embodiments of the present invention employ a displacement-type ink pump 30 that is located on the print carriage 12. The ink pump 30 is driven by the motion of an inertial mass or pendulum 32 in reaction to the acceleration of the print carriage 12 to which the pendulum 32 and its ink pump 30 are coupled. In a first exemplary embodiment, the ink pump 30 is a diaphragm-type pump, wherein a displacement volume 34 is partially enclosed by a flexible diaphragm 36. The diaphragm 36 is actuated by a piston or slider 38, which is mechanically coupled to the pendulum 32 by means of a lever mechanism that generates a mechanical advantage, thus increasing the force applied to the diaphragm as will be described in further detail below.

The pump 30 includes a displacement volume housing 40 having a chamber 42 formed therein that is capped by the domed diaphragm 36, carried on a diaphragm plate 37, to provide the displacement volume 34. The chamber 42 includes an ink inlet 44 and an ink outlet 46 extending out through an outer end 48 of the displacement volume housing 40, where the outer end 48 receives a valve plate 50, which includes an inlet reed valve 52 in fluid communication with the ink inlet 44 of the chamber 42 and an outlet reed valve 54 in fluid communication with the ink outlet 46 of the chamber. An end cap 56 is attached to the valve plate 50 and includes a pump inlet 58 in fluid communication with the inlet reed valve 52 and a pump outlet 60 in fluid communication with the outlet reed valve 54.

The opposite end of the pump 30 includes a driver housing 62 containing the pump driver assembly 64, which drives the operation of the pump by activating the actuator/diaphragm 36 in reaction to lateral movement (illustrated by arrow 16) of the print carriage to which the pump 30 is attached. The driver housing 62 includes an elongated passage 66 extending perpendicular to the diaphragm 36 within which a piston or slider 38 reciprocates to continuously compress and release (i.e., activate) the diaphragm, which in turn causes ink to flow through the pump 30 as will be described in greater detail below. The pendulum 32 is pivotally coupled to the driver housing 62 below the slider 38 by a pivot pin 70, which extends through a bearing hole 71 in the pendulum 32, such that the pendulum 32 swings in the opposite direction that the print carriage 12 moves. In other words, the pendulum 32 swings on an axis extending substantially perpendicular to the direction 16 of carriage travel. The pendulum 32 includes an inertial mass arm 72 extending below the pivot pin 70 (and below the driver housing 62) and includes a follower arm 74 extending above the pivot pin and into a slot provided in the bottom of the slider 38, where it is pivotally coupled to the slider 38 by a cylindrical boss 76 on the inertial mass arm that is received within a bearing seat in the slider 38. The inertial mass arm 72 of the pendulum includes a relatively large cylindrical mass 78 provided thereon to provide most of the inertial mass for the inertial mass arm 72.

Specific dimensions and associated design data of this exemplary embodiment are provided (for illustration purposes only, and without intending to be limited thereto) as follows:

| | |
|---|---|
| Carrier Acceleration | 1 g (386 in/sec$^2$) |
| Min Travel | (accel or decal) 10.8 mm<br>(0 to 18.1 to 0 in/sec; 0.0938 sec accel/decel) |
| Pendulum Mass | 11.99 gm |
| Pendulum/Slide Ratio | 3.93/1 (8.84/2.5) |
| Slide Force | 47.12 gmf |
| Slide Stroke | 3.0 mm |
| Diaphragm Area | 19.63 mm$^2$ |
| Displacement Volume | 0.0318 cm$^3$ |
| Design Pressure | 2.5 psi |
| Ideal Max Flow Rate | 0.339 cm$^3$/sec |

In alternate embodiments the Pendulum Mass has a mass of approximately 2 grams to approximately 200 grams; and the Pendulum/Slide Ratio is between approximately 0.5 and approximately 10 to one.

An equation that may be used to determine certain dimensions and values for the pump is provided as follows:

$$P\frac{Q}{Sq} = k \times Mi \times A \qquad \text{Eq. 1}$$

where, $S_M$ Stroke of the Inertial Mass
k Mechanical Advantage or ($S_M/S_Q$)
$M_i$ Inertial Mass
a Acceleration
Q Pump Volume Displacement
P Pressure
A Displacement Area
$S_Q$ Stoke of the Displacement Area
d Displacement Diameter Usually values of P, a, $M_i$, and $S_M$ are chosen first, and the equation is solved for the needed mechanical advantage k.

Additionally the following equations are utilized:

The diameter equation:

$$d = \sqrt{\frac{4 \times 4}{\pi}} \qquad \text{Eq. 2}$$

The mechanical advantage definition:

$$k = \frac{S_M}{S_Q} \qquad \text{Eq. 3}$$

In the exemplary embodiment, when the pump 30 is coupled to an associated print head on the print carriage 12, an ink supply is coupled to the pump inlet 58 with a supply line tube and the pump outlet 60 is connected to an accumulator & vent tank by an output supply tube. The accumulator serves as a small reservoir of ink feeding a pressure regulator in the print head. The regulator serves to reduce the positive ink supply pressure to the negative (back pressure) pressure just above the print head's ejection nozzles.

Referring to FIGS. 3 and 4, to explain the operations of the pump, the ink pump 30 would be attached to the print carriage 12 in a manner so that the pendulum 32 would be free to swing on the pivot pin 70 as the print carrier 12 moves in the direction of the carrier travel 16. When the print carriage 12 accelerates to the right, inertia will cause the inertial mass arm 72 to swing to the left (in the opposite direction), swinging from position A to position B. This motion of the pendulum 32 causes the slider 38 to slide to the right proportionally with respect to the relative arm lengths of the pendulum 32. For the exemplary embodiment shown, the pendulum 32 would be displaced 10.8 mm to the left, causing the slider 38 to displace 3 mm to the right. The slider 38 contacts and compresses the dome of the diaphragm 36, and the described displacement reduces the displacement volume 34, thus expelling ink from that volume out through the ink outlet 46, reed valve 54 and pump outlet 60. On reversal of carrier acceleration (movement to the left), inertial will cause the inertial mass arm 72 to swing to the right, swinging from position B to position A. This motion of the pendulum 32 causes the slider 38 to slide to the left proportionally away from the diaphragm 36, allowing the displacement volume 34 to be returned to the original state. In this return motion, the resulting suction will pull ink through the pump inlet 58, reed valve 52 and ink inlet 44 to refill the displacement volume 34 with ink.

Thus, for a design pressure of 2.5 psi with a displacement of 0.032 cc's, the exemplary embodiment inertial mass pump 30 weighs only approximately 18 gms. In comparison to the inertial mass pumps of the prior art, which would have weighed approximately 40 to 50 gms for the same performance, the advantage of the present invention is clear. An additional advantage of the exemplary embodiment of the inertial mass pump 30 the pump 30 is relatively small such that multiple pumps can easily be incorporated into a printer's carriage as described and illustrated below. Additionally, the exemplary embodiment of the pump 30 requires virtually no control system. When the print carriage is in motion the pump is supplying ink, and when not in motion the pump is not supplying ink. The exemplary embodiment is also self pressure limiting in that the maximum pressure is limited to that of the acceleration of the carrier.

Figure 5:
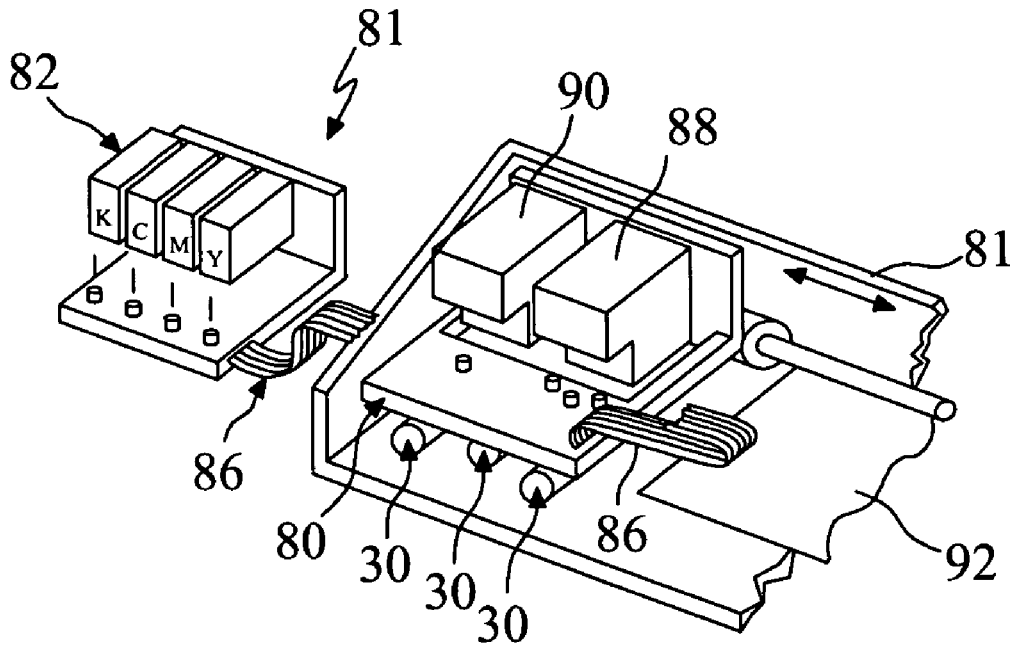
FIG. 5 is partial perspective view of an ink jet printer incorporating exemplary embodiments of the ink pump according to the present invention.

As shown in FIG. 5, the compact size that may be achieved using the exemplary embodiment of this invention enables multiple ink pumps 30 to be fitted to a single print carriage 80, thus allowing the use of multiple ink systems for color printing. The printer 81 shown in FIG. 5 contains four ink supply tanks 82, one for each ink color (K, C, M, Y), stored in a fixed location within the printer housing 84. The ink supply tanks 82 are respectively connected to pump inlets 58 (not shown in FIG. 5) of each of the four pumps 30 mounted on the print carriage 80 by means of a flexible tubing 86. The print carriage 80 seats a pair of print heads, a tri-color print head 88 coupled to the C, M & Y pumps 30 and a mono print head 90 coupled to the K pump 30, for printing upon the print medium 92 as the print carriage is driven laterally along the print medium 92.

Following from the above description and invention summaries, it should be apparent to those of ordinary skill in the art that, while the apparatuses and methods herein described constitute exemplary embodiments of the present invention, the inventions contained herein are not limited to these precise embodiments and that changes may be made to them without departing from the scope of the inventions as defined by the claims. For example, as will be appreciated by those of ordinary skill in the art, it is within the scope of the invention that the pump be a different type of displacement pump such as a bellows pump or a piston type pump. With such alternate pumps, the inertial mass would be coupled to the pump actuator by a mechanical linkage, such as a lever mechanism as described above, that provides a mechanical advantage. It is also within the scope of the invention that, as will be appreciated by those of ordinary skill in the art, alternate mechanical linkages providing a mechanical advantage may be utilized such as a gear system, a cam system or any other known mechanical advantage linkage. Further, with the multiple pump embodiments (such as shown and described in FIG. 5) it is within the scope of the invention that a single pendulum (or any other mechanical advantage linkage) is coupled to, and drives more than one pump.

It will also be appreciated by those of ordinary skill that while the exemplary embodiments described and illustrated herein have the inertial mass arm 72 extending below the pump and printer carriage, it is within the scope of the invention that the inertial mass arm extends or resides in other orientations or positions. The pendulum will operate in any orientation so long as the pivot axis is sufficiently perpendicular to the direction of carriage acceleration so as to experience the responsive movements to acceleration described herein. The exemplary embodiments have the inertial mass arm hanging below the pivot axis, but embodiments of the invention works sufficiently well with the inertial mass arm hung at angles, sideways, and even upside-down.

It will be further appreciated by those of ordinary skill that the slider 38 can also be coupled to the inertial mass arm 72 rather than to the follow arm (i.e., the slider 38 place on the same side of the pivot), by pivotally coupling the slider 38 to the inertial mass arm at a point closer to the pivot 70 than the inertial mass 78.

Additionally, it is to be understood that the invention is defined by the claims and it not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A print carriage and ink supply system for a printer, comprising:

a print carriage adapted for lateral reciprocation along a print medium within a printer, the print carriage including at least one print head;

an ink pump including an ink inlet in fluid communication with an ink source, an ink outlet in fluid communication with the print head, and a pump actuator for at least initiating displacement of ink through the ink pump upon actuation; and a pendulum pivotally coupled to the print carriage for pivotal movement with respect to the print carriage in reaction to acceleration of the print carriage laterally along the print medium, the pendulum being mechanically linked to the pump actuator;

whereby the pendulum actuates the pump at least upon certain accelerations of the print carriage laterally along the print medium.

2. The print carriage and ink supply system of claim 1, wherein the pendulum is pivotally coupled to the print carriage at a pivot point and includes an internal mass arm extending from the pivot point and an opposing actuator arm extending from the pivot point, the actuator arm being mechanically linked to the pump actuator.

3. The print carriage and ink supply system of claim 2, wherein the actuator arm is coupled to a piston carried on the ink pump, the piston having a reciprocation path, and the piston being in contact with the pump actuator along at least a portion of the piston's reciprocation path.

4. The print carriage and ink supply system of claim 3, wherein the pump is a displacement type pump.

5. The print carriage and ink supply system of claim 4, wherein the pump is a diaphragm pump and the pump actuator includes a pump diaphragm enclosing at least a portion of a displacement volume of the diaphragm pump.

6. The print carriage and ink supply system of claim 5, wherein the diaphragm pump includes a pump housing containing the displacement volume, the pump diaphragm, the pump inlet in fluid communication with the displacement volume, and the pump outlet in fluid communication with the displacement volume.

7. The print carriage and ink supply system of claim 6, wherein the pump housing is coupled to the print carriage, the pump housing contains the piston, and the pendulum is pivotally coupled to the pump housing.

8. The print carriage and ink supply system of claim 6, wherein the pump housing contains a first check valve in fluid communication with the valve inlet and a second check valve in fluid communication with the valve outlet.

9. The print carriage and ink supply system of claim 8, wherein the first and second check valves comprise reed valves.

10. The print carriage and ink supply system of claim 2, wherein the inertial mass arm of the pendulum is substantially longer and heavier than the actuator arm of the pendulum.

11. The print carriage and ink supply system of claim 10, wherein the inertial mass arm has a mass of approximately 2 grams to approximately 200 grams.

12. The print carriage and ink supply system of claim 10, wherein the ratio of pivot distance of travel between the inertial mass arm and the actuator arm is between approximately 0.5 and approximately 10 to one.

13. The print carriage and ink supply system of claim 12, wherein the inertial mass arm has a mass of approximately 2 grams to approximately 200 grams.

14. The print carriage and ink supply system of claim 13, wherein the actuator arm is coupled to a piston carried on the ink pump, the piston having a reciprocation path, and the piston being in contact with the pump actuator along at least a portion of the piston's reciprocation path.

15. The print carriage and ink supply system of claim 4, wherein the pump is a diaphragm pump, the pump actuator includes a pump diaphragm enclosing at least a portion of a displacement volume of the diaphragm pump, and the displacement volume of the pump is approximately 0.002 $cm^3$ to approximately 1 $cm^3$.

16. The print carriage and ink supply system of claim 1, wherein the pendulum is coupled to a reciprocating body carried on the ink pump, the reciprocating body having a reciprocation path, and the reciprocating body being in contact with the pump actuator along at least a portion of the piston's reciprocation path.

17. The print carriage and ink supply system of claim 1, wherein the pendulum is pivotally coupled to the print carriage at a pivot point and includes an internal mass arm extending from the pivot point, the inertial mass arm being mechanically linked to the pump actuator.

18. The print carriage and ink supply system of claim 17, wherein the inertial mass arm is coupled to a piston carried on the ink pump, the piston having a reciprocation path, and the piston being in contact with the pump actuator along at least a portion of the piston's reciprocation path.

19. A print carriage and ink supply system for a printer, comprising:

a print carriage adapted for lateral reciprocation along a print medium within a printer, the print carriage including at least one print head;

an ink pump including an ink inlet in fluid communication with an ink source, an ink outlet in fluid communication with the print head, and a pump actuator for at least initiating displacement of ink through the ink pump upon actuation; and an inertial mass coupled to the print carriage for reciprocating movement with respect to the print carriage in opposing reaction to acceleration of the print carriage laterally along the print medium;

the inertial mass being indirectly linked to the pump actuator by a mechanical linkage;

whereby the combination of the inertial mass and the mechanical linkage actuates the pump at least upon certain accelerations of the print carriage laterally along the print medium.

20. The print carriage and ink supply system of claim 19, wherein the inertial mass is provided on a first arm of a pendulum pivotally coupled to the print carriage, and the pendulum is a component of the mechanical linkage.

21. The print carriage and ink supply system of claim 20, wherein the mechanical linkage includes a piston pivotally coupled to an opposing arm of the pendulum, the piston is mounted for reciprocation along a piston path on the print carriage, and the piston path includes the pump actuator.

22. The print carriage and ink supply system of claim 21, wherein the pump is a displacement type pump.

23. The print carriage and ink supply system of claim 22, wherein the pump is a diaphragm pump and the pump actuator includes a pump diaphragm enclosing at least a portion of a displacement volume of the diaphragm pump.

24. The print carriage and ink supply system of claim 23, wherein the diaphragm pump includes a pump housing containing the displacement volume, the pump diaphragm, the pump inlet in fluid communication with the displacement volume, and the pump outlet in fluid communication with the displacement volume.

25. The print carriage and ink supply system of claim 24, wherein the pump housing is coupled to the print carriage, the pump housing contains the piston, and the pendulum is pivotally coupled to the pump housing.

26. The print carriage and ink supply system of claim 24, wherein the pump housing contains a first check valve in fluid communication with the valve inlet and a second check valve in fluid communication with the valve outlet.

27. The print carriage and ink supply system of claim 26, wherein the first and second check valves comprise reed valves.

28. The print carriage and ink supply system of claim 20, wherein the first arm of the pendulum is substantially longer and heavier than the opposing arm of the pendulum.

29. The print carriage and ink supply system of claim 28, wherein the first arm has a mass of approximately 2 grams to approximately 200 grams.

30. The print carriage and ink supply system of claim 28, wherein the ratio of pivot distance of travel between the first arm and the opposing arm is between approximately 0.5 and approximately 10 to one.

31. The print carriage and ink supply system of claim 30, wherein the first arm has a mass of approximately 2 grams to approximately 200 grams.

32. The print carriage and ink supply system of claim 31, wherein the opposing arm is coupled to a piston carried on the ink pump, the piston having a reciprocation path, and the pump actuator being positioned along at least a portion of the piston's reciprocation path.

33. The print carriage and ink supply system of claim 19, wherein the inertial mass extends outwardly with respect to the print carriage and reciprocates a swinging motion.

34. The print carriage and ink supply system of claim 33, wherein the inertial mass extends below the print carriage.

35. The print carriage and ink supply system of claim 19, further comprising a plurality of the ink pumps for a corresponding plurality of printer inks.

36. The print carriage and ink supply system of claim 35, further comprising a corresponding plurality of the inertial mass and mechanical linkage combinations for the respective plurality of the ink pumps.

37. The print carriage and ink supply system of claim 35, wherein:

the plurality of ink pumps each respectively include a pump actuator; and the inertial mass is indirectly linked to each of the pump actuators by the mechanical linkage.

38. The print carriage and ink supply system of claim 19, wherein the mechanical linkage is a mechanical advantage linkage.

39. The print carriage and ink supply system of claim 38, wherein the mechanical advantage linkage includes a lever mechanism.

40. The print carriage and ink supply system of claim 38, wherein the mechanical advantage linkage includes at least one of:

a lever mechanism;

a gear mechanism; and a cam mechanism.

41. The print carriage and ink supply system of claim 19, wherein the pump is a displacement type pump.

42. The print carriage and ink supply system of claim 41, wherein the displacement type pump is taken from a group consisting of:

a diaphragm pump;

a bellows pump; and a piston-type pump.

43. A printer comprising:

a printer housing;

a drive assembly provided in the printer housing for driving a print medium through the printer housing;

a print carriage adapted for lateral reciprocation along a print medium carried by the drive assembly within the printer housing, the print carriage including at least one print head;

a controller for coordinating the operations of the drive assembly and print carriage with respect to each other;

an ink pump provided in the printer housing, including an ink inlet in fluid communication with an ink source, an ink outlet in fluid communication with the print head, and a pump actuator for at least initiating displacement of ink through the ink pump upon actuation;

an inertial mass coupled to the print carriage for reciprocating movement with respect to the print carriage in opposing reaction to acceleration of the print carriage laterally along the print medium; and a mechanical advantage linkage coupling the inertial mass to the pump actuator;

whereby the combination of the inertial mass and the mechanical advantage linkage actuates the pump at least upon certain accelerations of the print carriage laterally along the print medium.

44. The printer of claim 43, wherein the inertial mass is provided on a first arm of a pendulum pivotally coupled to the print carriage, and the pendulum is a component of the mechanical advantage linkage.

45. The printer of claim 44, wherein the mechanical advantage linkage includes a piston pivotally coupled to an opposing arm of the pendulum, the piston is mounted for reciprocation along a piston path on the print carriage, and the piston path includes the pump actuator.

46. The printer of claim 45, wherein the pump is a diaphragm pump and the pump actuator includes a pump diaphragm enclosing at least a portion of a displacement volume of the diaphragm pump.

47. The printer of claim 45, wherein the first arm of the pendulum is substantially longer and heavier than the opposing arm of the pendulum.

48. The printer of claim 44, wherein the mechanical advantage linkage includes a piston pivotally coupled to the first arm of the pendulum, the piston is mounted for reciprocation along a piston path on the print carriage, and the piston path includes the pump actuator.

49. The printer of claim 43, wherein the inertial mass extends outwardly with respect to the print carriage and reciprocates a swinging motion.

50. The printer of claim 49, wherein the inertial mass extends below the print carriage.

51. The printer of claim 43, further comprising a plurality of the ink pumps for a corresponding plurality of printer inks.

52. The printer of claim 51, further comprising a corresponding plurality of the inertial mass and mechanical advantage linkage combinations for the respective plurality of the ink pumps.

53. The printer of claim 51, wherein:

the plurality of ink pumps each respectively include a pump actuator; and the inertial mass is indirectly linked to each of the pump actuators by the mechanical advantage linkage.

54. The printer of claim 43, wherein the mechanical advantage linkage includes a lever mechanism.

* * * * *